US005723251A

United States Patent [19]

Moser

[11] Patent Number: 5,723,251

[45] Date of Patent: Mar. 3, 1998

[54] METHOD AND APPARATUS FOR REMOVING LIQUID CARRIER IN A LIQUID DEVELOPING MATERIAL-BASED ELECTROSTATOGRAPHIC PRINTING SYSTEM

[75] Inventor: Rasin Moser, Fairport, N.Y.

[73] Assignee: Xerox Corporation, Stamford, Conn.

[21] Appl. No.: 785,115

[22] Filed: Jan. 21, 1997

[51] Int. Cl.[6] ..... G03G 13/11; G03G 15/11

[52] U.S. Cl. ..... 430/126; 430/112; 430/119; 430/97; 399/249; 399/308

[58] Field of Search ..... 430/119, 126; 399/302, 308, 249

[56] References Cited

U.S. PATENT DOCUMENTS

| | | | |
|---|---|---|---|
| 3,901,702 | 8/1975 | Sankus et al. | 430/41 |
| 4,286,039 | 8/1981 | Landa | 430/119 |
| 4,796,048 | 1/1989 | Bean | 430/126 |
| 5,028,964 | 7/1991 | Landa et al. | 430/126 |
| 5,414,498 | 5/1995 | Buchan et al. | 399/239 |
| 5,493,369 | 2/1996 | Sypula et al. | 399/240 |
| 5,521,037 | 5/1996 | Nagase et al. | 430/126 |
| 5,592,269 | 1/1997 | Younes et al. | 399/308 |

*Primary Examiner*—Roland Martin
*Attorney, Agent, or Firm*—Denis A. Robitaille

[57] ABSTRACT

A liquid developing material-based electrostatographic printing system including a carrier imbibing intermediate transfer member for absorbing liquid carrier from a liquid developed image transported thereon. A liquid extraction system is also provided for extracting imbibed liquid carrier from the liquid carrier imbibing layer of the intermediate transfer member.

16 Claims, 3 Drawing Sheets

Figure 1:
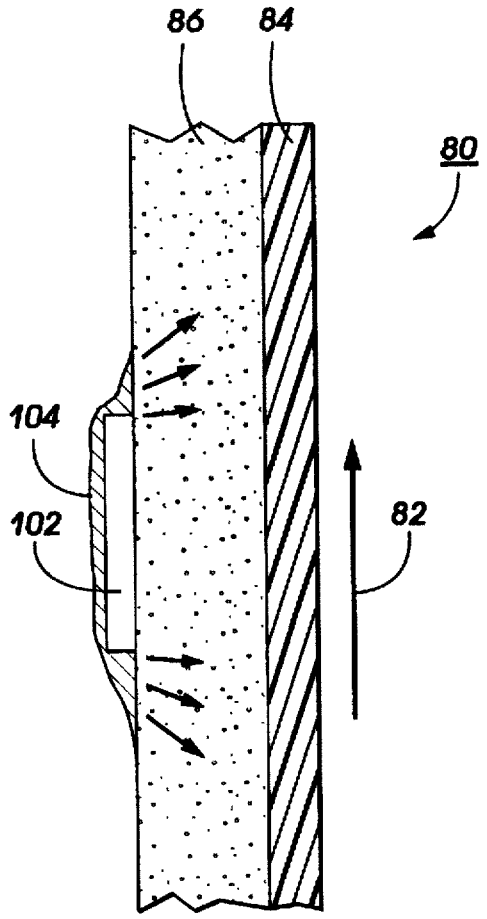

METHOD AND APPARATUS FOR REMOVING LIQUID CARRIER IN A LIQUID DEVELOPING MATERIAL-BASED ELECTROSTATOGRAPHIC PRINTING SYSTEM

This invention relates generally to a liquid developing material based electrostatographic printing machine, and, more particularly, concerns a method and apparatus for removing excess liquid carrier from a developed image on an intermediate transfer member to minimize the effects of transferring excess liquid carrier to a final output copy substrate.

Generally, the process of electrostatographic copying is initiated by exposing a light image of an original document to a substantially uniformly charged photoreceptive member. Exposing the charged photoreceptive member to light in an imagewise configuration discharges the photoconductive surface thereof in areas corresponding to non-image areas in the original input document while maintaining the charge in image areas, resulting in the creation of a latent electrostatic image on the photoreceptive member. This latent image is subsequently developed into a visible image by a process in which charged developing material is deposited onto the surface of the photoreceptive member. Typically, this developing material comprises carrier granules having toner particles adhering triboelectrically thereto, wherein the toner particles are electrostatically attracted from the carrier granules to the latent image for forming a developed powder image on the photoreceptive member. Alternatively, liquid developing materials comprising a liquid carrier material having toner particles dispersed therein have been successfully utilized, wherein the liquid developing material is applied to the latent image with the toner particles being attracted toward the image areas to form a developed image. Regardless of the type of developing material employed, the toner particles making up the developed image are subsequently transferred from the photoreceptive member to a copy substrate, either directly or by way of an intermediate transfer member. Thereafter, the image may be permanently affixed to the copy substrate to produce a "hard copy" reproduction or print of the original document or file. A final process step typically involves cleaning the photoreceptive member to remove any residual charge and/or developing material from the photoconductive surface in preparation for subsequent imaging cycles.

The above described electrostatographic reproduction process is well known and is useful for light lens copying from an original input document as well as for printing applications involving electronically generated or stored data representing the desired output image. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images.

The electrostatographic printing process described above exemplifies a basic process for producing monocolor output images. This process can be modified to produce multicolor images. For example, a so-called subtractive color mixing process can be utilized to create so-called process multicolor images by overlaying color separated images of three colors, namely cyan, magenta and yellow. One exemplary method for producing process multicolor images is described as the Recharge, Expose, and Development (READ) process, wherein different color toner layers are deposited in superimposed registration with one another on a photoconductive surface or other recording medium to create a multilayered, multicolored, toner image thereon. In this process, the recording medium is initially exposed to record a latent image thereon corresponding to a first subtractive color. This image is developed with appropriately colored developing material at a first development station. Thereafter, the recording medium having the developed image thereon is recharged and re-exposed to record a latent image corresponding to another subtractive primary color superimposed on the previous image. This image is again developed with appropriately colored developing material and the process is repeated until all the different color toner layers are deposited in superimposed registration with one another to form a multilayer, multicolor image. Variations on this general technique for forming multicolor images, wherein a plurality of developed images are superimposed on one another, are well known in the art and may make advantageous use of the present invention.

As noted hereinabove, the use of liquid developing materials in electrostatographic imaging processes is well known. Indeed, various types of liquid developing materials and development systems have been disclosed for use in electrostatographic printing applications. Liquid developing materials have many advantages, and typically produce images of higher quality than images formed with dry toners. Most notably, since liquid developing materials are comprised of marking particles immersed in a liquid carrier, the marking particles can be made to be very small without the resultant problems typically associated with small particle powder toners such as airborne contamination which can adversely affect machine reliability and can create potential health hazards. The use of very small toner particles is particularly advantageous in multicolor processes wherein multiple layers of toner generate the final multicolor output image. Further, full color prints made with liquid developers can be processed to a substantially uniform finish, whereas uniformity of finish is difficult to achieve with powder toners due to variations in the toner pile height, among other factors.

Liquid developing materials typically contain about 2 percent by weight fine solid particulate toner material dispersed in a hydrocarbon-based liquid carrier solution. After the latent image is developed on an imaging member, the developed image thereon generally contains about 12 percent by weight of the solid particulate toner in the liquid hydrocarbon carrier. However, it is desirable that this solids percentage be increased to at least about 25 percent for a liquid image on the photoreceptor, and as high as 50 percent prior to transfer to a copy substrate. To that end, various systems have been disclosed for removing excess liquid from a developed liquid image, either on a photoreceptor or on an intermediate transfer member. An exemplary system involves an electrically conductive roller which is urged against the developed image, wherein the electrical bias is of the same polarity as the charged toner in the liquid developing material such that the toner is repelled from the roller. The roller member wipes away excess liquid from the image and while the biasing potential applied thereto pushes away the toner particles making up the image so as to prevent distortion thereof during this wiping process.

Also as previously noted, it is known in the art to transfer a developed image to an intermediate transfer member prior to transfer of the image to a final support substrate. The use of an intermediate transfer member is particularly advantageous in producing multicolor output prints via the various processes known and associated with electrostatic printing processes. Intermediate transfer members enable higher output copy speeds in certain multicolor applications and can also provide improved registration for producing the final output multicolor image. In addition, with particular respect to liquid developing material based electrostatographic imaging systems, intermediate transfer members permit certain image conditioning techniques useful in preparing the liquid image for transfer to a copy sheet. Various examples of intermediate transfer members can be found in U.S. Pat. Nos. 5,537,194; 5,521,037; 5,119,140; 5,110,702; and 5,099,286, among numerous other patents and technical literature.

The present invention is directed toward an apparatus and method for removing excess liquid from a liquid developed image by providing an intermediate transfer member having the capability to absorb or imbibe liquid carrier from a developed liquid image residing on the surface thereof. The apparatus and method of the present invention further involves a system for removing the imbibed liquid from the intermediate transfer member. The following disclosures may be relevant to some aspects of the present invention:

U.S. Pat. No. 4,796,048

Patentee: Bean issued: Jan. 3, 1989

U.S. Pat. No. 5,028,964

Patentee: Landa et al.

Issued: Jul. 2, 1991

U.S. Pat. No. 5,521,037

Patentee: Nagase et al.

Issued: May 28, 1996

The relevant portions of the foregoing patents may be briefly summarized as follows:

U.S. Pat. No. 4,796,048 discloses a resilient intermediate transfer member and apparatus for liquid ink development, wherein a plurality of liquid images are transferred from a photoconductive member to a copy sheet. The liquid images, which include a liquid carrier having toner particles dispersed therein, are attracted from the photoconductive member to an intermediate belt by a biased transfer roll, such that the liquid carrier is squeegeed from the intermediate belt and the toner particles are compacted thereon in image configuration. Thereafter, the toner particles are transferred from the intermediate belt to the copy sheet in image configuration with the use of another biased transfer roll.

U.S. Pat. No. 5,028,964 discloses an apparatus for image transfer which comprises an intermediate transfer member and a squeegee for removing excess liquid from the toner image prior to transferring an image. The intermediate transfer member is operative for receiving the toner image and transferring the toner image to a receiving substrate. Transfer of the image to the intermediate transfer member is aided by providing electrification of the intermediate transfer member to a voltage having the same bias as that of the charged particles. The roller is charged to a potential having the same polarity as the charge of the toner particles of the liquid developer.

U.S. Pat. No. 5,521,037 discloses an intermediate transfer material and an image forming method using the intermediate transfer member in a liquid developing material based electrostatographic printing apparatus, wherein a developed liquid image is transferred to the intermediate transfer member and subsequently retransferred from the intermediate to a final support substrate. The intermediate transfer member includes at least a silicone rubber layer, an adhesive layer, and a conductive fluorine rubber substrate. That patent indicates that the intermediate transfer material provides excellent durability and transferability, for producing high quality images at high reproducibility.

In accordance with one aspect of the present invention there is provided an apparatus for removing liquid carrier from a liquid developed image. The apparatus comprises an intermediate transfer member for transporting a liquid developed image, wherein the intermediate transfer member includes a liquid carrier absorbent layer for receiving the liquid developed image, capable of absorbing at least a portion of the carrier liquid residing therein. The apparatus further comprises a liquid extraction system for extracting absorbed carrier liquid from the liquid carrier absorbing layer of the intermediate transfer member.

In accordance with another aspect of the present invention, a liquid developing material based electrostatographic printing system is provided including an apparatus for removing liquid carrier from a liquid developed image. The apparatus for removing liquid carrier comprises an intermediate transfer member for transporting a liquid developed image, wherein the intermediate transfer member includes a liquid carrier absorbent layer for contacting the liquid developed image to absorb at least a portion of the carrier liquid of the liquid developed image, and further includes a liquid extraction system for extracting absorbed carrier liquid from the liquid carrier absorbing layer of the intermediate transfer member.

In accordance with yet another aspect of the present invention, a method for removing liquid carrier from a liquid developed image is provided, comprising the steps of transferring a liquid developed image to an intermediate transfer member for transporting the liquid developed image, wherein the intermediate transfer member includes a liquid carrier absorbent layer for contacting the liquid developed image to absorb at least a portion of the carrier liquid therefrom; transferring the liquid developed image off of the intermediate transfer member such that at least a portion of the absorbed carrier liquid remains imbibed in the liquid carrier absorbent layer; and compressing the intermediate transfer member for extracting absorbed carrier liquid from the liquid carrier absorbing layer of the intermediate transfer member.

Figure 2:
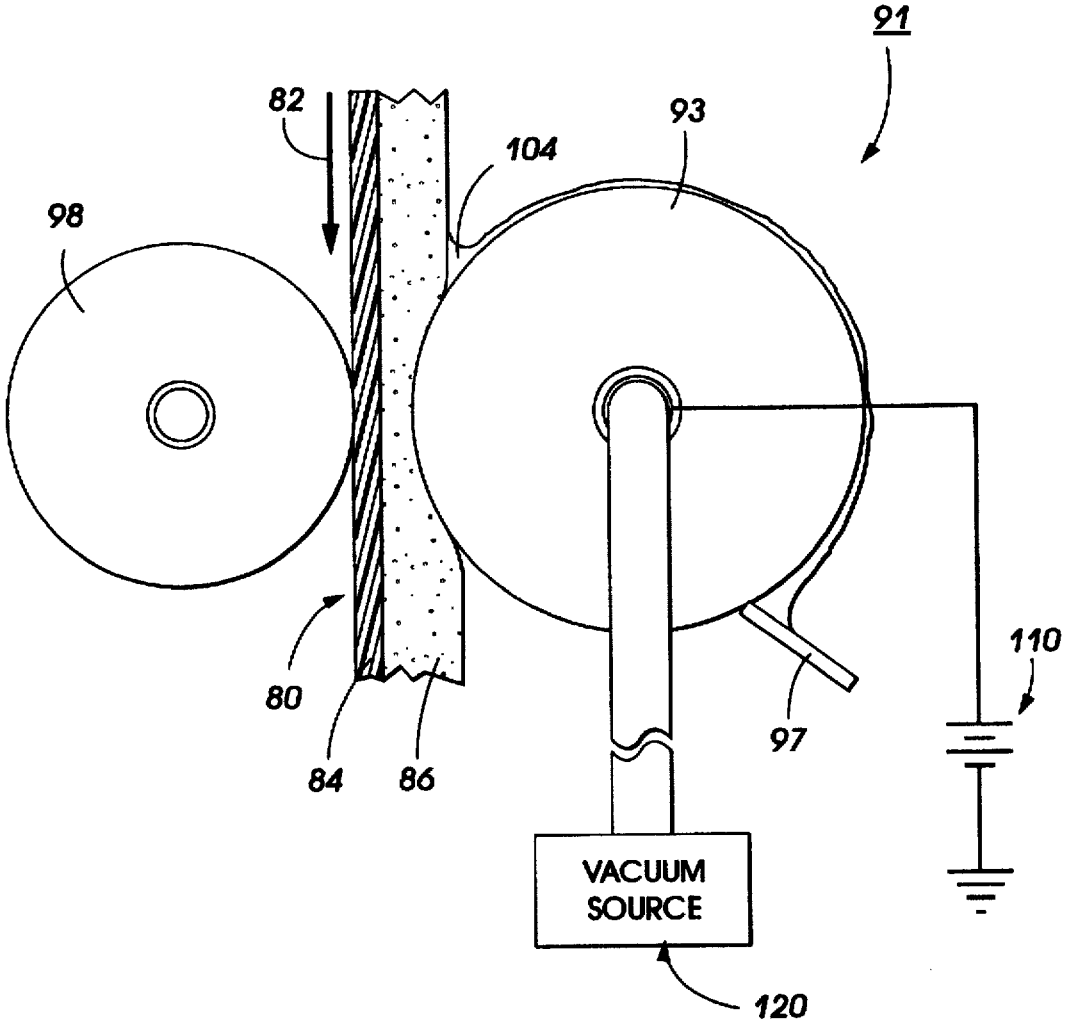
Figure 3:
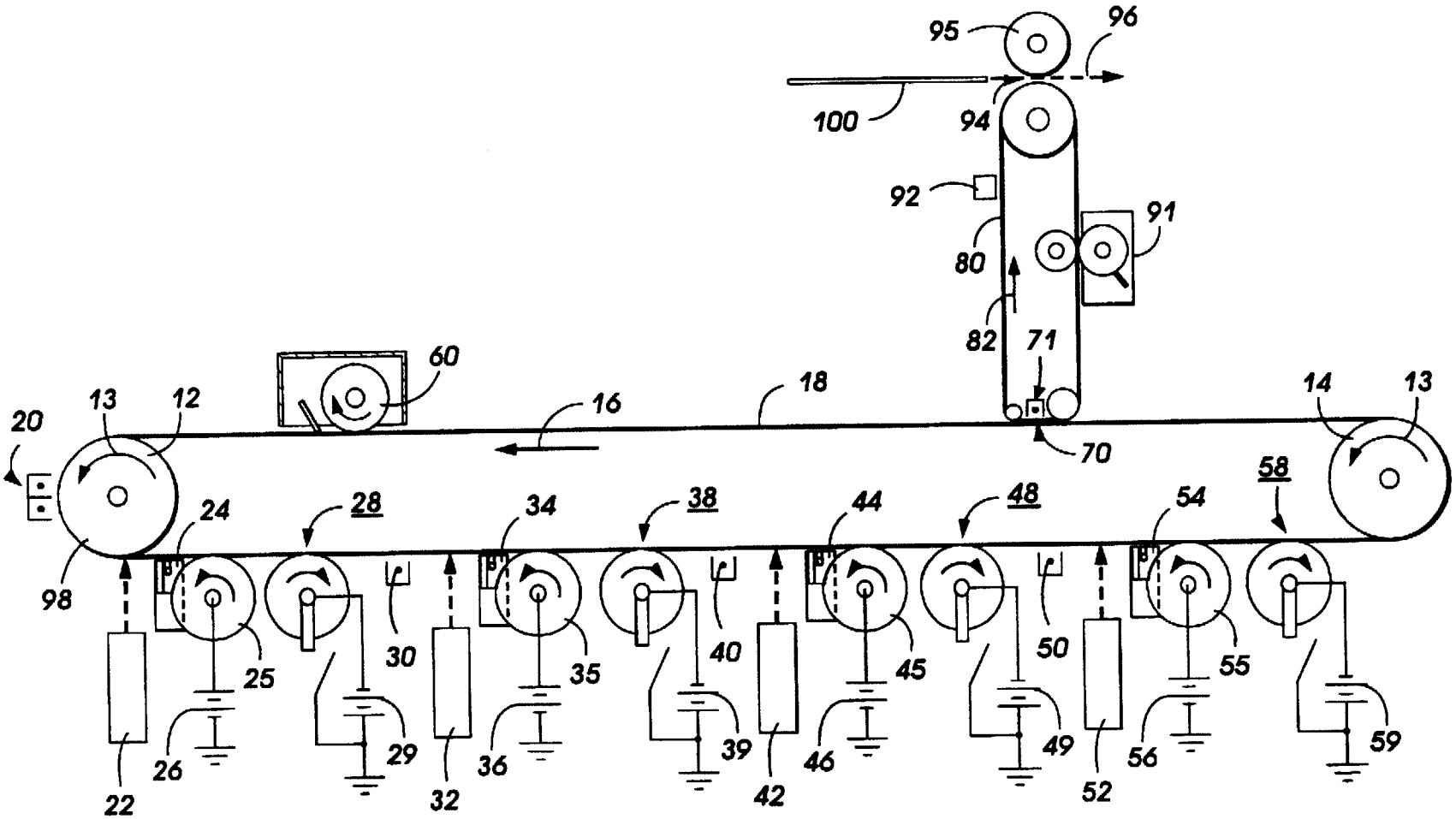

Other aspects of the present invention will become apparent as the following description proceeds and upon reference to the drawings, in which:

FIG. 1 is a cross-sectional view of a carrier imbibing intermediate transfer member in accordance with the present invention, showing a liquid developed image thereon;

FIG. 2 is a schematic elevational view of the carrier imbibing intermediate transfer member of Figure 1, illustrating a liquid extraction system for removing imbibed liquid from the intermediate transfer member in accordance with the present invention; and FIG. 3 is a schematic, elevational view of an exemplary multicolor liquid developing material based electrostatographic printing machine incorporating the method and apparatus for removing excess liquid carrier, in accordance with the present invention.

For a general understanding of the features of the present invention, reference is made to the drawings, wherein like reference numerals have been used throughout to designate identical elements. FIG. 3 is a schematic elevational view illustrating an exemplary multicolor electrostatographic printing machine incorporating the features of the present invention. Inasmuch as the art of electrostatographic printing is well known, the various processing stations employed in the printing machine of FIG. 3 will be described briefly prior to describing the invention in detail. It will become apparent from the following discussion that the apparatus of the present invention may be equally well-suited for use in a wide variety of printing machines and is not necessarily limited in its application to the particular electrostatographic machine described herein. While the present invention will hereinafter be described in connection with a preferred embodiment thereof, it will be understood that the description of the invention is not intended to limit the invention to this preferred embodiment. On the contrary, the description is intended to cover all alternatives, modifications, and equivalents as may be included within the spirit and scope of the invention as defined by the appended claims.

Turning now to FIG. 3, the multicolor electrostatographic printing machine shown employs a photoreceptive belt 10 which comprises a multilayered structure, including a photoconductive surface deposited on an electrically grounded conductive substrate, wherein the photoconductive surface is preferably made from a selenium alloy and the conductive substrate is preferably made from an aluminum alloy. The photoreceptive belt 10 is transported along a curvilinear path defined by rollers 12 and 14 for advancing successive portions of the photoreceptive belt 10 sequentially through the various processing stations disposed about the path of movement thereof. These rollers are spaced apart and may be rotatably driven in the direction of arrows 13 by a suitable motor or drive system (not shown) so as to advance belt 10 in the direction of arrow 16.

Initially, the belt 10 passes through a charging station where a corona generating device 20 charges the photoconductive surface of belt 10 to relatively high, substantially uniform electrical potential.

After the substantially uniform charge is placed on the photoreceptive surface of the belt 10, the printing process proceeds by either placing an input document onto the surface of a transparent imaging platen (not shown) for imaging thereof or by providing a computer generated image signal for discharging the photoconductive surface in accordance with the image to be generated. For multicolor printing and copying, the imaging process typically involves the separation of imaging information into individual color components for providing a series of subtractive imaging signals, with each subtractive imaging signal being proportional to the intensity of the incident light of each of the primary color components. These imaging signals are then transmitted to a series of individual raster output scanners (ROSs) 22, 32, 42 and 52 for generating complementary, color separated, latent images on the charged photoreceptive belt 10. Each ROS 22, 32, 42 and 52 typically writes the latent image information on to the photoreceptor in a pixel by pixel manner, as known in the art of electrophotography.

The present description is directed toward a Recharge, Expose, and Develop (REaD) process, wherein the charged photoconductive surface of photoreceptive member 10 is serially exposed to record a series of latent images thereon corresponding to the subtractive color of one of the colors of the appropriately colored toner particles at a corresponding development station. Thus, the photoconductive surface is continuously recharged and re-exposed to record latent images thereon corresponding to the subtractive primary of another color of the original. This latent image is therefore serially developed with appropriately colored toner particles until all the different color toner layers are deposited in superimposed registration with one another on the photoconductive surface. It should be noted that either discharged area development (DAD) discharged portions are developed, or charged area development (CAD), wherein charged areas are developed can be employed, as will be described. It will be recognized that this REaD process represents only one of various multicolor processing techniques that may be used in conjunction with the present invention.

In the exemplary electrostatographic system of FIG. 3, each of the color separated electrostatic latent images are serially developed on the photoreceptive belt 10 via a fountain-type developing apparatus 24, 34, 44 and 54, which may be of the type disclosed in U.S. Pat. No. 5,579,473 wherein appropriately colored developing material is transported into contact with the surface of belt 10. By way of example, developer apparatus 24 transports cyan colored liquid developing material, developer apparatus 34 transports magenta colored liquid developing material, developer apparatus 44 transports yellow colored liquid developing material, and developer apparatus 54 transports black colored liquid developing material. Each different color developing material is comprised of charged toner particles disseminated through the liquid carrier, wherein the toner particles are attracted to the latent image areas on the surface of belt 10 by electrophoresis for producing a visible developed image thereon.

Generally, in a liquid developing material-based system, the liquid carrier medium makes up a large amount of the liquid developing composition. Specifically, the liquid medium is usually present in an amount of from about 80 to about 98 percent by weight, although this amount may vary from this range. By way of example, the liquid carrier medium may be selected from a wide variety of materials, including, but not limited to, any of several hydrocarbon liquids, such as high purity alkanes, such as Norpar® 12, Norpar® 13, and Norpar® 15, and including isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons have also been shown to provide a suitable liquid carrier media.

The toner particles can be any pigmented particle compatible with the liquid carrier medium, such as those contained in the developing materials disclosed in, for example, U.S. Pat. No. 3,729,419; 3,968,044; 4,476,210; 44,794,651; and 5,451,483, among numerous other patents. The toner particles preferably have an average particle diameter from about 0.2 to about 10 microns, and more precisely from about 0.5 to about 2 microns. The toner particles may be present in amounts of from about 1 to about 10 percent by weight, and preferably from about 1 to about 4 percent by weight of the developer composition. The toner particles can consist solely of pigmented particles, or may comprise a resin and a pigment; a resin and a dye; or a resin, a pigment, and a dye. Examples of suitable resins include poly(ethyl acrylate-co-vinyl pyrrolidone), poly(N-vinyl-2-pyrrolidone), and the like. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers. Dyes generally are present in an amount of from about 5 to about 30 percent by weight of the toner particle, although other amounts may be present provided that the objectives of the present invention are achieved. Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that combine well with any polymeric material also included in the developer composition. Pigment particles are generally present in amounts of from about 5 to about 40 percent by weight of the toner particles, and preferably from about 10 to about 30 percent by weight.

In addition to the liquid carrier vehicle and toner particles which typically make up the liquid developer materials suitable for use in a liquid developing material based electrostatographic machine, a charge control additive (sometimes referred to as a charge director) may also be included for facilitating and maintaining a uniform charge on toner particles by imparting an electrical charge of selected polarity (positive or negative) to the toner particles. Examples of suitable charge control agents include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight, and preferably from about 0.02 to about 0.05 percent by weight of the developer composition.

Continuing now with a discussion of the multicolor printing process, as depicted in FIG. 3, the developer station may also include a metering roll 25, 35, 45, 55 situated adjacent to a corresponding developer fountain 24, 34, 44 and 54 and in close proximity to the surface of photoreceptive belt 10. The metering roll generally rotates in a direction opposite the movement of the photoconductor surface so as to exert a shear force on the liquid developed image in the area of the nip formed therebetween the surface of the photoreceptor. This shear force removes an initial amount of the liquid developing material from the surface of the photoreceptor for minimizing the thickness of the developing material thereon. The excess developing material removed by the metering roll eventually falls away from the rotating metering roll for collection in a sump, not shown. A DC power supply 26, 36, 46, 56 may also be provided for maintaining an electrical bias on the metering roll at a selected polarity for enhancing image development. Each of the developer stations shown in FIG. 3 are substantially identical to one another and represent only one of various known apparatus or systems that can be utilized to apply liquid developing material to the photoconductive surface or other image recording medium.

After image development, the liquid developed image on the photoconductor 10 may be further processed or "conditioned" to compress the image and remove amounts of the liquid carrier therefrom, as shown, for example, by U.S. Pat. No. 4,286,039 or 5,493,369, among various other patents. This so-called image conditioning process typically increases the solids percentage of the image to approximately 25%. An exemplary apparatus for image conditioning is shown at reference numerals 28, 38, 48 and 58, each comprising a roller which may preferably include a porous body and a perforated skin covering. The image conditioning rolls 28, 38, 48 and 58 are typically biased to a potential having a polarity which inhibits the departure of toner particles from the image on the photoreceptor 10, while compacting the toner particles of the image onto the surface thereof. In an exemplary image conditioning system of U.S. Pat. No. 5,493,369, a vacuum source (not shown) may also be provided, coupled to the interior of the roller, for creating an airflow through the porous roller body to draw liquid from the surface of the photoreceptor, thereby increasing the percentage of toner solids in the developed image. In operation, rollers 28, 38, 48 and 58 rotate against the liquid image on belt 10 such that the porous body of roller 28 absorbs excess liquid from the surface of the image through the pores and perforations of the roller skin covering. The vacuum source draws liquid through the roller skin to a central cavity for depositing the liquid in a receptacle or some other location which permits either disposal or recirculation of the liquid carrier. The porous roller is this continuously discharged of excess liquid to provide continuous removal of liquid from the developed image on belt 10. It will be recognized by one of skill in the art that the vacuum assisted liquid absorbing roller described hereinabove may also find useful application in an embodiment in which the image conditioning system is provided in the form of a belt, whereby excess liquid carrier is absorbed through an absorbent foam layer in the belt, as described in U.S. Pat. Nos. 4,299,902 and 4,258,115.

In the presently described illustrative multicolor printing process after image conditioning of the first developed image, imaging and development are repeated for subsequent color separations by recharging and reexposing the belt 10, whereby color image information is superimposed over the previous developed image. For each subsequent exposure an adaptive exposure processing system may be employed for modulating the exposure level of the raster output scanner (ROS) 32, 42 or 52 for a given pixel as a function of the developing material previously developed at the pixel site, thereby allowing toner layers to be made independent of each other, as described in U.S. Pat. No. 5,477,317. The reexposed image is next advanced through a corresponding development station and subsequently through an associated image conditioning station, for processing in the manner previously described. Each step is repeated as previously described to create a multilayer image made up of black, yellow, magenta, and cyan toner particles as provided via each developing station. It should be evident to one skilled in the art that the color of toner at each development station could be provided in a different arrangement.

After the multilayer image is created on the photoreceptive member 10, it is advanced to an intermediate transfer station 70 for transferring the image from the photoconductive belt 10 to an intermediate transfer member, identified by reference numeral 80, for subsequent transfer to a copy substrate 100. A charging device such as a corona generating device 71, a biased transfer roller (not shown), or any other electrostatic transfer device may be provided for assisting image transfer to the intermediate member 80. Thereafter, the intermediate transfer member continues to advance in the direction of arrow 82 to a transfer nip 94 where the developed image is transferred and affixed to a recording sheet 100 transported through nip 94 in the direction of arrow 96. The intermediate member 80 may be provided in the form of either a rigid roll or an endless belt, as shown in FIG. 3, having a path defined by a plurality of transport rollers in contact with the inner surface thereof.

It will be understood from the foregoing discussion of the electrostatographic imaging process that the developed image on the intermediate transfer member 80 is subsequently transferred to a copy substrate. Prior to transfer of the image from the intermediate transfer member, the liquid developed image thereon may be charged by, for example, exposure to a corona generating element (not shown) to insure that all of the toner particles making up the developed image are charged to the same polarity, thereby enhancing transfer efficiency by eliminating any toner particles that have become charged to a polarity opposite to that of the majority of the toner particles during the electrostatographic imaging process. Thereafter, transfer of the liquid developed image from the intermediate transfer member to the copy substrate 100 can be carried out by any suitable technique conventionally used in electrophotography, such as corona transfer, pressure transfer, bias roll transfer, and the like. In addition, transfer methods such as adhesive transfer, or differential surface energy transfer, wherein the receiving substrate has a higher surface energy with respect to the developing material making up the image, can also be employed.

After the developed image is transferred to intermediate member 80, residual liquid developer material may remain on the photoconductive surface of belt 10. A cleaning station 60 is therefore provided, which may include a roller 62 formed of any appropriate synthetic resin and which may be driven in a direction opposite to the direction of movement of belt 10, for scrubbing the photoconductive surface clean. It will be understood, that a number of photoconductor cleaning devices exist in the art, any of which would be suitable for use with the present invention. In addition, any residual charge left on the photoconductive surface may be extinguished by flooding the photoconductive surface with light from lamp (not shown) in preparation for a subsequent successive imaging cycle. In this way, successive electrostatic latent images may be developed and transferred for producing additional copies and/or prints.

As noted hereinabove, the image on the photoreceptor 10, after image conditioning thereof, typically has a solids percentage in the range of approximately 25%. Similarly, therefore, the image transferred to the intermediate transfer member 80 has a solids percentage in the range of approximately 25%. However, the optimal solids content for transfer of a liquid image to a copy substrate is above approximately 50%. This solids percentage assures minimal hydrocarbon emissions from an image bearing copy substrate and further advantageously minimizes or eliminates carrier showthrough on the copy substrate. Thus, it is desirable to remove excess liquid from the developed image on the intermediate 80, prior to transfer of that image to the copy sheet 100. To that end, the present invention is directed toward the intermediate transfer member having the capability to imbibe or absorb liquid carrier from a developed liquid image residing on the surface thereof for increasing the solids content of the liquid image preferably above 50%. As such, the intermediate transfer member of the present invention is comprised of a material that allows it to absorb at least a portion of the liquid carrier in the liquid image transferred thereto such that the solid to liquid ratio of the image can be increased by the absorptive action of the intermediate transfer member 80.

The foregoing discussion provides a general description of the operation of a liquid developing material based electrostatographic printing machine incorporating the liquid imbibing intermediate transfer member of the present invention. The detailed structure of the carrier imbibing intermediate transfer member along with a description of an exemplary device for removing imbibed carrier liquid from the intermediate transfer member will be described hereinafter with reference to FIGS. 1 and 2. It will be understood that the intermediate transfer member and carrier liquid removal apparatus of the present invention may be utilized in a multicolor electrophotographic printing machine or, in a monocolor printing machine. Multicolor printing machines may use this type of intermediate transfer member and associated liquid removal system where successive latent images are developed on the photoreceptor in superimposed registration to form a composite multicolor image which is subsequently transferred to the intermediate or where single color liquid images are successively transferred onto the intermediate in superimposed registration with one another for creating the multilayer image thereon.

Moving now to FIG. 1, a cross-sectional view of a preferred structure of the intermediate transfer belt 80 of the present invention is shown. The intermediate transfer member 80 preferably comprises a multi-layer structure including a supportive substrate layer 84 having an absorptive carrier liquid imbibing layer 86 adjoined thereto for contacting and receiving the developed liquid image, wherein the liquid image is made up of a compressed toner layer component 102 and a carrier liquid component 104. Due to the imbibing characteristics of the layer 86, the carrier liquid component contained in the developed image deposited on the intermediate transfer member 80 is absorbed by the absorptive layer 86. Suitable materials for the carrier liquid absorbing material layer 86 include elastic absorptive materials such as a foam material selected from the group consisting of polyurethane, silicone, fluorocarbon, polyimide, melamine and rubber. Specific materials which may be advantageously used include Permair®, a microporous polyurethane available from Porvair, Ltd. of England, and Tetrate®, a microporous semi-permeable fluorocarbon membrane available from Tetratex Corp. of Pennsylvania. It will be understood that various other materials which are also capable of absorbing petroleum solvents may also be preferably used as the absorptive layer 86. It will be understood that the material used in the absorptive layer 86 should be selected with the properties of the intermediate transfer member 80 and the type of carrier liquid employed in the liquid developing material taken into consideration. The carrier imbibing nature of this absorptive layer prepares the image for transfer to a copy sheet or other substrate 100. After transfer from the intermediate transfer member 80 to the substrate 100, the intermediate transfer member 80 continues to travel in the direction of arrow 82 to a liquid extraction subsystem for removing excess carrier liquid from the absorptive layer 86 of the intermediate transfer member 80. The liquid extraction subsystem may include a contact member for squeezing liquid from the absorptive layer, a vacuum system for "sucking" liquid from the absorptive layer, a heating or cooling member for "sweating" liquid from the absorptive layer, or any equivalent system which may be known by those of skill in the art.

One exemplary embodiment of such a liquid extraction subsystem is shown in FIG. 2, wherein the intermediate transfer member 80 is advanced through a liquid extraction nip, comprising liquid extraction roller 93 and backup roller 98. This liquid extraction system compresses the liquid containing absorptive layer 86 of the intermediate transfer member 80 so as to squeeze the liquid carrier therefrom. Preferably, the liquid extraction roll 93 exerts sufficient pressure against the surface of the adhesive layer 86 such that the liquid discharged therefrom is carried over to the surface of the liquid extraction roller 93 where this excess liquid migrates away from the liquid extraction nip. The migration of this liquid may be induced via rotational movement of the surface of the liquid extraction roller 93 such that the present invention contemplates that the roller member may be rotatably mounted for rotating in a direction opposite the direction of movement of the intermediate transfer member so as to transport extracted liquid away from the intermediate. Thereafter, the excess liquid can be removed from the surface of the liquid extraction roller 93 by means, for example, of a scraper blade 97. The liquid developing material recovered by the scraper 97 may be returned into a developer tank (not shown) or to a developing material reclaim system for being recycled into the liquid developing material.

Thus, in accordance with the present invention, a liquid extraction system is provided for extracting absorbed liquid from the carrier imbibing intermediate transfer member 80 so that the carrier liquid absorbing capacity of the absorptive layer 86 thereof can be maintained with each cycle of transfer of a liquid developed image thereto. It is noted that enhanced embodiments of the liquid extraction system shown in FIG. 2 may include an electrical bias 100 applied to the liquid extraction roller 93, wherein the electrical bias is of a polarity for attracting any residual charged toner particles from the surface of the intermediate transfer member, thereby removing toner particles which may be deposited thereon and which may result in the deterioration of the carrier liquid the absorbing capacity of the absorptive layer 86.

In addition, or alternatively, a vacuum source 120 may be provided, wherein the liquid extraction roll 93 is provided in the form of a permeable member such that the vacuum source assists in drawing liquid carrier from the absorptive layer 86. In this embodiment is contemplated that the liquid extraction roller 93 include a porous body, preferably having a perforated skin covering. The roller may be biased to a potential having a polarity which attracts residual toner particles from the intermediate transfer member 80. In operation, the roller is urged against the absorptive layer 86 of the intermediate transfer member 80 such that the vacuum source 120 provides a negative air flow at the surface of the liquid extraction roller 93, and particularly at the entrance to the nip formed thereby, such that the porous body of the roller draws excess liquid from the intermediate transfer member 80 through the pores and perforations of the roller skin covering. The vacuum source, typically coupled to one end of the central cavity of the liquid extraction roller 93 may draw the liquid all the way through the roller skin to the central cavity for depositing the liquid in a receptacle or some other location which permits either disposal or recirculation of the liquid. It will be recognized by one of skill in the art that the vacuum assisted liquid extraction roller described hereinabove may also find useful application in an embodiment in which the liquid extraction system is provided in the form of a belt, whereby excess liquid carrier is attracted away from the intermediate transfer member through a perforated layer in the belt member, in a manner similar to that described in U.S. Pat. Nos. 4,299,902 and 4,258,115.

In review, a method and apparatus for removing liquid carrier in a liquid developing material based electrostatographic printing system has been disclosed, wherein the present invention includes a carrier imbibing intermediate transfer member for absorbing at least a portion of the carrier liquid from a liquid developed image transferred thereto. In addition, a method and apparatus for extracting absorbed liquid from the intermediate transfer member is disclosed by the present invention. Preferably, this extracted liquid carrier material can be reclaimed for reuse in the liquid development process of the electrostatographic printing machine.

It is, therefore, apparent that there has been provided, in accordance with the present invention, a method and apparatus for removing liquid carrier in a liquid developing material based electrostatographic printing system, and, more particularly, a carrier imbibing intermediate transfer member in combination with a liquid extraction system for releasing imbibed carrier liquid from the intermediate transfer member. This method and apparatus fully satisfies the aspects of the invention hereinbefore set forth. It will be understood that, while this invention has been described in conjunction with specific embodiments thereof, many alternatives, modifications, and variations will be apparent to those skilled in the art. Accordingly, the present invention is intended to embrace all such alternatives, modifications and variations as falls within the spirit and broad scope of the appended claims.

I claim:

1. A method for removing carrier liquid from a liquid developed image, comprising the steps of:

transferring a liquid development image to an intermediate transfer member for transporting the liquid developed image, said intermediate transfer member including a liquid carrier absorbent layer for contacting the liquid developed image to absorb at least a portion of the carrier liquid of the liquid developed image;

transferring the liquid developed image off of the intermediate transfer member such that the absorbed carrier liquid remains imbibed in said liquid carrier absorbent layer;

compressing the intermediate transfer member for extracting absorbed carrier liquid from said liquid carrier absorbing layer thereof; and applying an electrical bias to an area adjacent a surface of the intermediate transfer member, said electrical bias providing an electrical bias having a polarity opposite to a polarity of toner particles in the liquid developing material for attracting residual toner particles from the surface of the intermediate transfer member.

2. The method of claim 1, further including the step of transporting the extracted liquid away from the intermediate transfer member.

3. The method of claim 2, further including the step of scraping away extracted liquid being transported away from the intermediate transfer member.

4. The method of claim 1, further including the step of creating a negative air pressure at an area adjacent a surface of the intermediate transfer member for assisting in the extraction of excess liquid therefrom.

5. An apparatus for removing carrier liquid from a liquid developed image, comprising:

an intermediate transfer member for transporting a liquid developed image, said intermediate transfer member including a liquid carrier absorbent layer for contacting the liquid developed image to absorb at least a portion of the carrier liquid of the liquid developed image; and a liquid extraction system for extracting absorbed carrier liquid from said liquid carrier absorbing layer of said intermediate transfer member, said liquid extraction system including a member for compressing said liquid carrier absorbent layer so as to squeeze absorbed carrier liquid therefrom, and an electrical biasing source coupled to said compressing member, said electrical biasing source providing an electrical bias having a polarity opposite to a polarity of toner particles in the liquid developing material for attracting residual toner particles from the intermediate transfer member.

6. The apparatus of claim 5, wherein said liquid carrier absorbent layer includes an absorbent material selected from the group consisting of polyurethane, silicone, fluorocarbon, polyimide, melamine, polypropylene and rubber.

7. The apparatus of claim 1, wherein said compressing member includes a roll member, said roll member situated in contact with the liquid carrier absorbent layer of said intermediate transfer member for allowing extracted carrier liquid to migrate away therefrom.

8. The apparatus of claim 7, wherein said roll member is rotatably mounted for rotating in a direction opposite the direction of movement of the intermediate transfer member so as to transport extracted liquid away from the intermediate transfer member.

9. The apparatus of claim 8, further including a scraper blade for removing carrier liquid from a surface of the roller member.

10. The apparatus of claim 7, further including a vacuum source coupled to said roller member for creating a negative air pressure adjacent an area of interface between the roller member and the absorptive layer for assisting in the extraction of excess liquid therefrom.

11. A liquid developing material based electrostatographic printing system including an apparatus for removing carrier liquid from a liquid developed image, comprising:

an intermediate transfer member for transporting a liquid developed image, said intermediate transfer member including a liquid carrier absorbent layer for contacting the liquid developed image to absorb at least a portion of the carrier liquid of the liquid developed image; and a liquid extraction system for extracting absorbed carrier liquid from said liquid carrier absorbing layer of said intermediate transfer member, said liquid extraction system including a member for compressing said liquid carrier absorbent layer so as to squeeze absorbed carrier liquid therefrom, and an electrical biasing source coupled to said compressing member, said electrical biasing source providing an electrical bias having a polarity opposite to a polarity of toner particles in the liquid developing material for attracting residual toner particles from the intermediate transfer member.

12. The apparatus of claim 11, wherein said liquid carrier absorbent layer includes an absorbent material selected from the group consisting of polyurethane, silicone, fluorocarbon, polyimide, melamine, polypropylene and rubber.

13. The apparatus of claim 1, wherein said compressing member includes a roll member, said roll member being situated in contact with the liquid carrier absorbent layer of said intermediate transfer member for allowing extracted carrier liquid to migrate away therefrom.

14. The apparatus of claim 13, wherein said roll member is rotatably mounted for rotating in a direction opposite the direction of movement of the intermediate transfer member so as to transport extracted liquid away from the intermediate transfer member.

15. The apparatus of claim 14, further including a scraper blade for removing carrier liquid from a surface of the roller member.

16. The apparatus of claim 1, further including a vacuum source coupled to said roller member for creating a negative air pressure at an interface between the roll member and the absorptive layer for assisting in the extraction of excess liquid therefrom.

* * * * *